US006212811B1

(12) United States Patent
Jones

(10) Patent No.: US 6,212,811 B1
(45) Date of Patent: Apr. 10, 2001

(54) PICTURE FRAME

(76) Inventor: Gina E. Jones, 2106 Jarrod Pl., Smyrna, GA (US) 30080

( * ) Notice: Subject to any disclaimer, the term of this patent is extended or adjusted under 35 U.S.C. 154(b) by 0 days.

(21) Appl. No.: 09/207,567

(22) Filed: Dec. 8, 1998

(51) Int. Cl.[7] ..... A47G 1/06
(52) U.S. Cl. ..... 40/781; D6/303
(58) Field of Search ..... 40/781, 358, 661.05, 40/725; D6/303, 309; 428/7, 8, 11

(56) References Cited

U.S. PATENT DOCUMENTS

| | | | | |
|---|---|---|---|---|
| D. 261,463 | | 10/1981 | Martin . | |
| D. 300,088 | * | 3/1989 | Stuckel | D6/303 |
| D. 339,239 | | 9/1993 | Perkins | D6/303 |
| 1,095,829 | * | 5/1914 | Dunlap . | |
| 2,288,732 | | 7/1942 | Nickerson . | |
| 2,742,725 | * | 4/1956 | Esposito, Jr. . | |
| 3,503,147 | | 3/1970 | Herrin et al. . | |
| 3,624,939 | | 12/1971 | Gossard . | |
| 4,173,667 | * | 11/1979 | Rusch | 428/11 |
| 4,224,364 | | 9/1980 | Hunt . | |
| 4,418,497 | * | 12/1983 | Mastriano | 428/7 X |
| 4,592,936 | * | 6/1986 | Ferguson | 428/11 |
| 5,615,502 | * | 4/1997 | Gabrius | 40/570 |
| 5,713,147 | | 2/1998 | Johnson | 40/771 |

OTHER PUBLICATIONS

Best Catalog, Cover and p. 17, item M, Feb. 20, 1994.*

* cited by examiner

*Primary Examiner*—Joanne Silbermann
(74) *Attorney, Agent, or Firm*—Baker, Donelson, Bearman & Caldwell

(57) ABSTRACT

A picture frame (10) is provided having a front shell (11) and a mating rear shell (12). The front shell has a picture cavity (18) adapted to hold a picture therein. The exterior surfaces (14) and (15) of the front and rear shells, respectively, are configured to resemble a sports item. The front and rear shells also have a generally flat bottom surfaces (21) and (26) configured so that the center of gravity CG falls within the bounds of the bottom surfaces so that each shell is independently self standing. The rear shell has an interior surface (25) contoured and imprinted to resemble the interior of a scene corresponding to the sports item depicted by the exterior surfaces.

9 Claims, 2 Drawing Sheets

PICTURE FRAME

TECHNICAL FIELD

This invention relates generally to picture frames.

BACKGROUND OF THE INVENTION

Picture frames have existed for many years. Today's picture frames typically include a generally low profile, rectangular frame mounted about a rectangular sheet of glass. While the frame may be constructed of a variety of material with hundreds of potential colors, the basic design can be quite mundane.

Recently, picture frames have been designed having unique shapes, as shown in U.S. Pat. Nos. Des. 339,239 and Des. 261,463. These picture frames are designed to resemble baseballs. The three dimensional aspect of these frames provide for a unique appearance. These frames however still remain static, as they are intended to be merely viewed and are not intended to be interacted with by a viewer of the framed photograph.

It thus is seen that a need remains for a picture frame which is more dynamic. It is to the provision of such that the present invention is primarily directed.

SUMMARY OF THE INVENTION

In a preferred form of the invention, a picture frame comprises a front shell and a mating rear shell. The front shell has a viewing window therein and means for supporting a picture viewable through the viewing window. The front shell is configured to include a substantially flat bottom surface and a center of gravity aligned within the bottom surface with the front shell oriented substantially upright upon its bottom surface. The rear shell is configured to include a substantially flat bottom surface and a center of gravity aligned within the bottom surface with the rear shell oriented substantially upright upon its bottom surface. The picture frame also has coupling means for coupling the front and rear shell. With this construction the front and rear shells are independently self standing in both an independent position and a coupled position.

DETAILED DESCRIPTION

Figure 1:
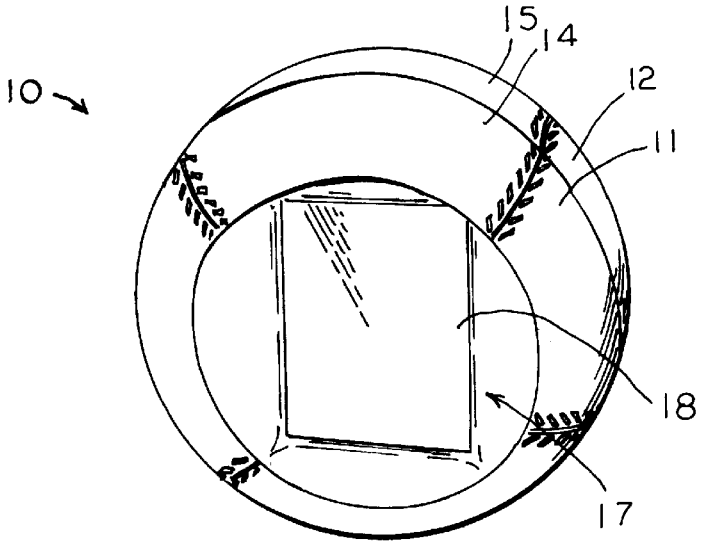
FIG. 1 is a perspective view of a picture frame of the present invention shown in a preferred form.

With reference next to the drawing, there is shown a picture frame 10 in a preferred form of the invention. The picture frame 10 is comprised of two portions, namely a front shell 11 and a rear shell 12 adapted to mate with the front shell 11. The exterior surfaces 14 and 15 of the front and rear shells, respectively, are configured to resemble a baseball.

The front shell 11 has a viewing window 17 therethrough extending to a picture cavity 18 having a moveable back panel 19. The front shell 11 also has a generally flat bottom surface 21, a peripheral step 22, and a center of gravity CG which falls within the bounds of the bottom surface 21. With this construction, the front shell is independently self standing upon the bottom surface when oriented generally upright.

The rear shell 12 has a peripheral rim 24 adapted to engage the front shell step 22 and an interior surface 25 contoured and imprinted to resemble the interior of a baseball stadium. The interior surface has a relief type contouring which provides for the representation of stadium stands, lights, signage and players. Hence, the exterior configuration of the shells directly relates to the interior subject matter represented by the interior surface 25. The rear shell 12 also has a generally flat bottom surface 26 an a center of gravity CG which falls within the bounds of the bottom surface 26 so that the rear shell also is independently self standing upon the bottom surface when oriented generally upright.

Figure 2:
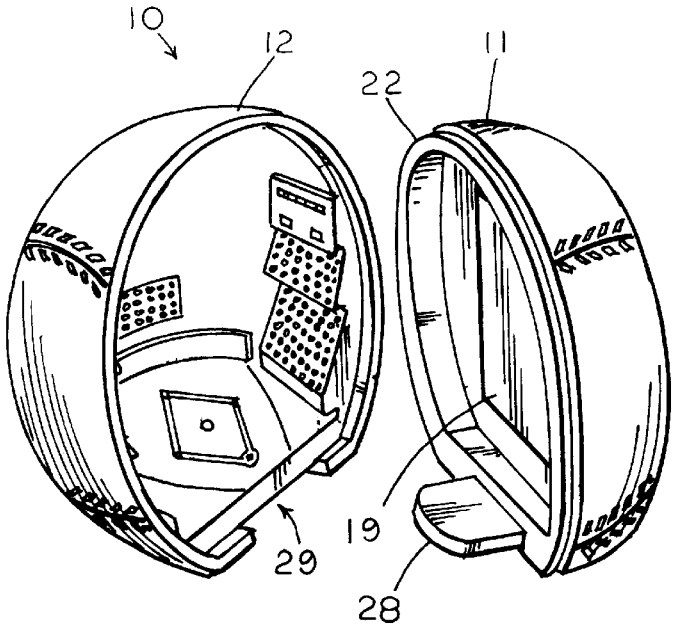
FIG. 2 is a perspective view of the picture frame of FIG. 1 shown with the two shells separated.
Figure 3:
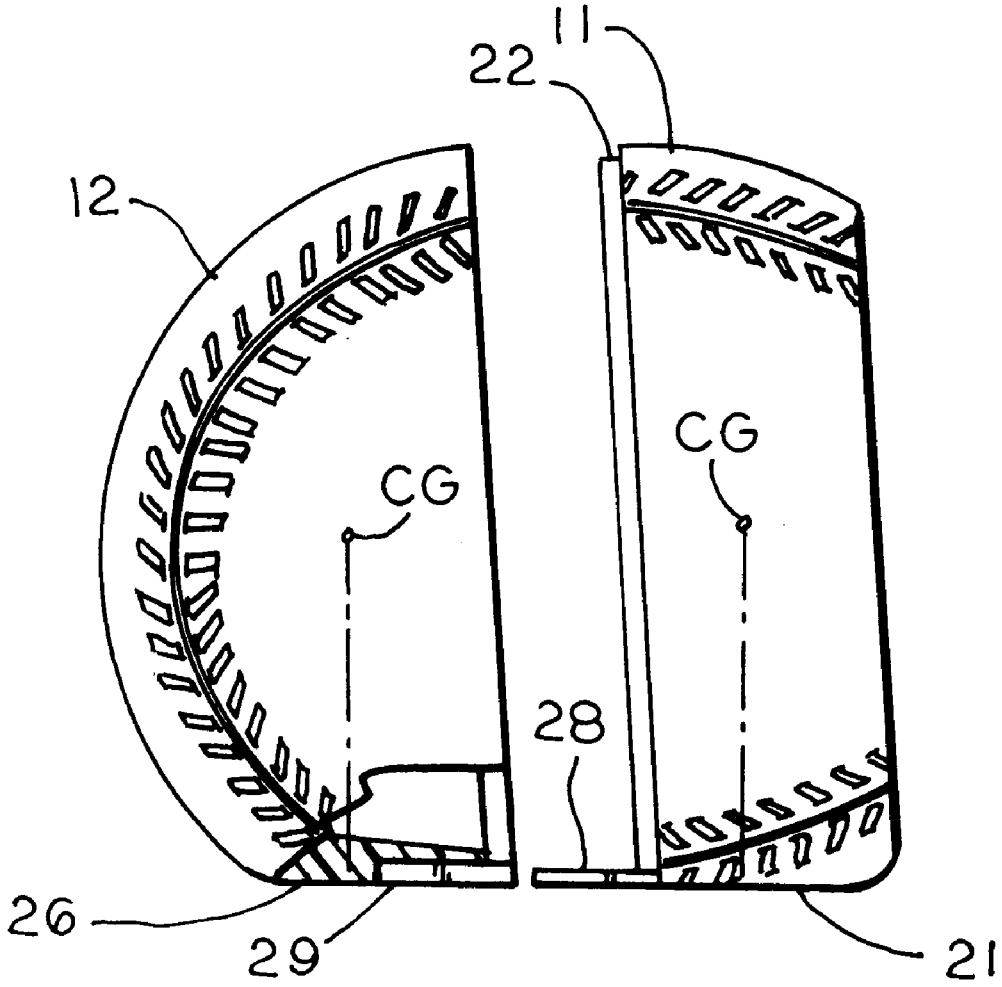
FIG. 3 is a cross-sectional view of the picture frame of FIG. 1.

The picture frame 10 of FIGS. 1–3 is shown with a tongue 28 extending from and having a bottom surface which is generally coplanar with the bottom surface 21 of the front shell 11. Tongue 28 is sized and shaped to be received within a groove 29 extending into the rear shell 12. It should be understood that the tongue 28 may be considered part of the bottom surface, as it may aid in supporting the front shell. However, the tongue is not mandatory to the present invention as the front shell may be configured with a center of gravity falling within the bottom surface absent the tongue, rendering the tongue unnecessary or at least minimizing its effectiveness.

It should be understood that the exterior surfaces 14 and 15 of the picture frame may be configured to resemble any selected item while the interior surface 25 of the rear shell is adapted to depict a scene corresponding to the selected item. As such, the picture frame may be configured to resemble any type of sports equipment or item while the interior surface is configured to depict the sports setting such as an arena, stadium, or playing field related to that item. Similarly, the picture frame may be configured to resemble any item associated with a particular event, location or the like depicted upon the interior surface. For example, the exterior may be shaped like an orange or sun with the interior surface having means for simulating a beach scene. It should also be understood that the front and rear shells may be coupled to each other by corresponding threads, a press fit configuration of the peripheral edges, tongue and groove members or other types of conventional latches. However, it is critical that each shell portion be self standing so that the picture may be properly displayed while the interior surface is likewise displayed for viewing.

From the foregoing, it is seen that a picture frame is now provided which provides a dynamic relation between the photograph held within the frame, the exterior configuration of the frame and a related scene within the frame. It should however be understood that the just described embodiment merely illustrates principles of the invention in its preferred forms. Many modifications, additions and deletions, in addition to those expressly recited, may of course, be made thereto without departure from the spirit and scope of the invention as set forth in the following claims.

What is claimed is:

1. A picture frame comprising:

an opaque front shell having an interior surface and an exterior surface, said front shell having a viewing window therein extending from said exterior surface so as be viewable from the exterior of said front shell and means for supporting a picture viewable through said viewing window, said front shell configured to include a substantially flat bottom surface and a center of gravity aligned within said bottom surface with the front shell oriented substantially upright upon said bottom surface;

an opaque rear shell configured to mate with said front shell, said rear shell having an exterior surface configured to include a substantially flat bottom surface and a center of gravity aligned within said bottom surface with the rear shell oriented substantially upright upon said bottom surface;

said front shell and said rear shell have exterior surfaces are sized and shaped to resemble a select item associated with a select location;

said rear shell interior surface is configured to represent said select location represented by said exterior surface;

coupling means for coupling said front shell and said rear shell, whereby the front and rear shells are independently self standing in both an independent position and a coupled position with each other and whereby the opaqueness of the shells hide the interior of the shells from view when the shells are coupled together.

2. The picture frame of claim 1 wherein said front shell includes a tongue having a bottom surface extending from and substantially co-planar with said bottom surface, and wherein said rear shell includes a groove sized and shaped to receive said tongue.

3. The picture frame of claim 1 wherein said exterior surfaces are configured to resemble a piece of sporting equipment of a select sports game, and wherein said rear shell interior surface has means for representing the setting of said select sports game.

4. A picture frame comprising:

a substantially opaque front shell, said front shell having an exterior facing viewing window therein and means for supporting a picture viewable through said viewing window, said front shell configured to include a bottom surface and a center of gravity aligned within said bottom surface with the front shell oriented substantially upright;

a substantially opaque rear shell configured to mate with said front shell, said rear shell configured to include a bottom surface and a center of gravity aligned within said bottom surface with the rear shell oriented substantially upright;

coupling means for coupling said front shell and said rear shell, whereby the front and rear shells are independently self standing in both an independent position and a coupled position with each other.

5. The picture frame of claim 4 wherein said front shell and said rear shell have substantially flat bottom surfaces, and wherein said front shell includes a tongue having a bottom surface extending from and co-planar with said bottom surface, and wherein said rear shell includes a groove sized and shaped to receive said tongue.

6. The picture frame of claim 4 wherein said front shell and said rear shell have exterior surfaces configure to resemble a select item associated with a select location, and wherein said rear shell has an interior surface having means for representing the select location.

7. The picture frame of claim 6 wherein said interior surface is configured to represent said select location.

8. The picture frame of claim 7 wherein said interior surface is configured to represent the setting of a select sports game.

9. The picture frame of claim 6 wherein said exterior surfaces are configured to resemble a piece of sporting equipment of a select sports game, and wherein said rear shell interior surface has means for representing the setting of said select sports game.

* * * * *